United States Patent [19]

Chang et al.

[11] Patent Number: 4,627,539

[45] Date of Patent: Dec. 9, 1986

[54] METHOD OF AND APPARATUS FOR TRANSPORTING GOODS

[76] Inventors: Wei-Chuan Chang, 49 Tung-An Lane, Lao-Pi Village, Nei-Pu Hsiang, Ping Tung Hsien; Yang Yin-Lung, 24-4 Lane 51, Yung Nien Street, Kaohsiung, both of Taiwan

[21] Appl. No.: 603,353

[22] Filed: Apr. 24, 1984

[51] Int. Cl.[4] ..... B65D 19/00

[52] U.S. Cl. ..... 206/597; 206/199; 206/600

[58] Field of Search ..... 206/386, 451, 597, 599, 206/600

[56] References Cited

U.S. PATENT DOCUMENTS 2,616,361 11/1952 Friesner ..... 206/597
2,822,921 2/1958 Wilson ..... 206/651

FOREIGN PATENT DOCUMENTS 2453084 4/1979 France ..... 206/586

*Primary Examiner*—Joseph Man-Fu Moy

[57] ABSTRACT

A transporting apparatus comprises a bottomless container case, a removable railing bottom plate, and a removable railing rack. Goods are piled on the railing rack in a size according to the size of the bottomless container case. Quick and automatic connection means are provided therebetween both the removable railing bottom plate and the open end of the bottomless container case for quickly and automatically connect the former to the latter. When the bottomless container case is put to cover the goods on the railing rack and the railing bottom plate is inserted into the bottomless container case through a slot on the lowest sidewall of the container case, entire goods will be transferred from the railing rack onto the railing bottom plate automatically after the bottomless container case together with the railing bottom plate have been hoisted away from the railing rack to transport. A pressure plate is added on each inside wall of the container case, telescoping means for moving said pressure plate forward to depress on the goods in the container for securing said goods in position, the pressure plate may be released by said telescoping means for easier on removing the container case when unloading the goods, further hoisting means is provided for hoisting the railing rack together with the goods for water proof in case of necessity.

2 Claims, 11 Drawing Figures

FIG. 6
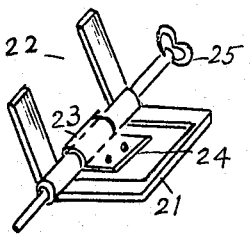
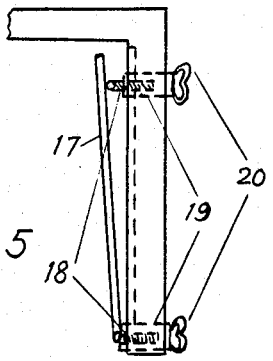
FIG. 5
FIG. 7
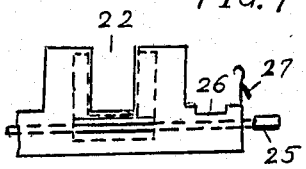
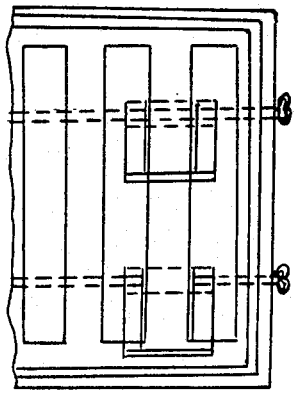
FIG. 9
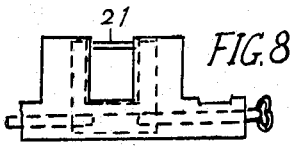
FIG. 8
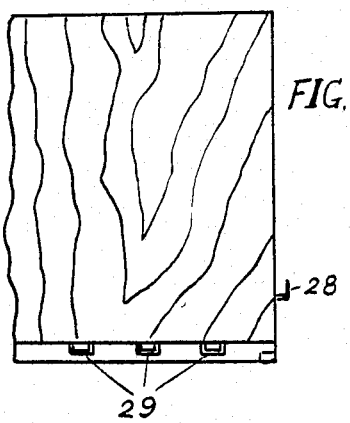
FIG. 10
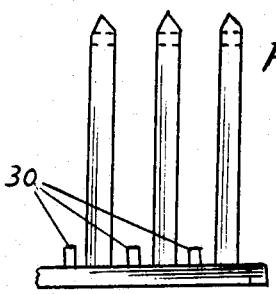
FIG. 11

METHOD OF AND APPARATUS FOR TRANSPORTING GOODS

BACKGROUND OF THE INVENTION

A number of methods of and apparatus for transporting goods have been employed in the past and at present time. These prior methods and apparatus require many man-hours to load goods one by one into a container, or to unload goods one by one out of the container, and often causes serious damage to the goods because of carelessness of the workers. The present invention employing a bottom removable container will load and unload the goods in a group, therefore it will save man-hour and reduce the possibility of damage during transportation. There was no means for securing goods in the container, therefore, said goods in the container may be shifted and displaced after a rough transportation which will cause possible damage to delicate goods and difficulty in removing the container case when unloading. Moreover, applicant's former invention had no bottom cover for the container, water may get into the container when it is transported on a desk of the ship in a stormy sea.

SUMMARY OF THE INVENTION

It is an object of the invention to provide a bottom removable container for loading and unloading goods in a group to save man-hour during transportation.

Another object of the invention is to provide a bottom removable container for loading and unloading the goods in their original order and packing condition to avoid damage to the goods.

Still another object of the invention is to provide an easier way for inspection or picking up any desired one package of the goods in the container by simply remove the bottom of the container and the container case and then reinstall them in a fastest way.

It is the primary object of our improvement, therefore, to provide a means for securing the goods in the container during transport, but said means may be loosened purposely for easier on removing the container case when unloading the goods.

Other objects will become apparent in the description taken in connection with the accompanyed drawings.

BRIEF DESCRIPTION OF DRAWINGS

FIG. 5 is a portion side sectional view of the container case wherein an adjustable pressure plate is installed.

FIG. 6 is a perspective view of a hook for hoisting the railing rack.

FIG. 7 is an elevated view of the hook when it is in one position with its open end up.

FIG. 8 is an elevated view of the hook when it is rotated 90 degrees in another position with its open end lied down.

FIG. 9 is a top view of the hook when they are installed on the railing rack.

FIG. 10 is an elevated view of the container case, several connecting rings are fastened on the front lower edge of the case.

FIG. 11 is a top view of the railing bottom plate, a numbers of connecting pins are formed integral on the lateral bar between the railing bars.

DESCRIPTION OF THE PREFFERED EMBODIMENT

Figure 1:
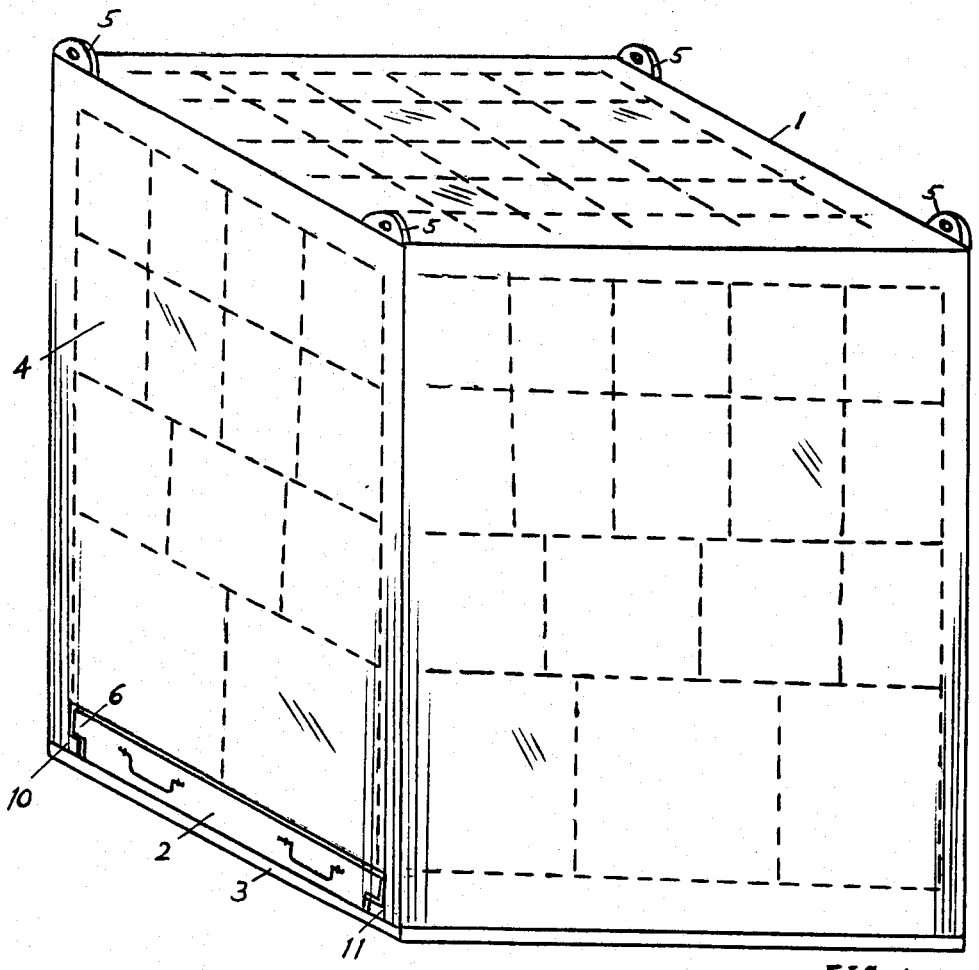
FIG. 1 is a perspective view of a bottom removable container loaded with goods.
Figure 4:
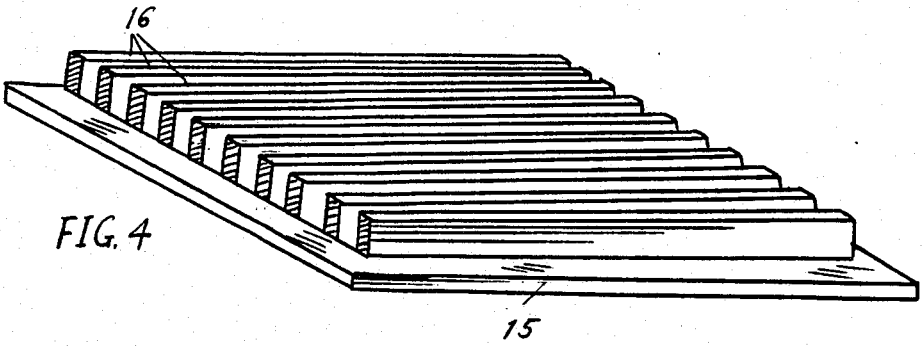
FIG. 4 is a perspective view of a railing rack.
Figure 2:
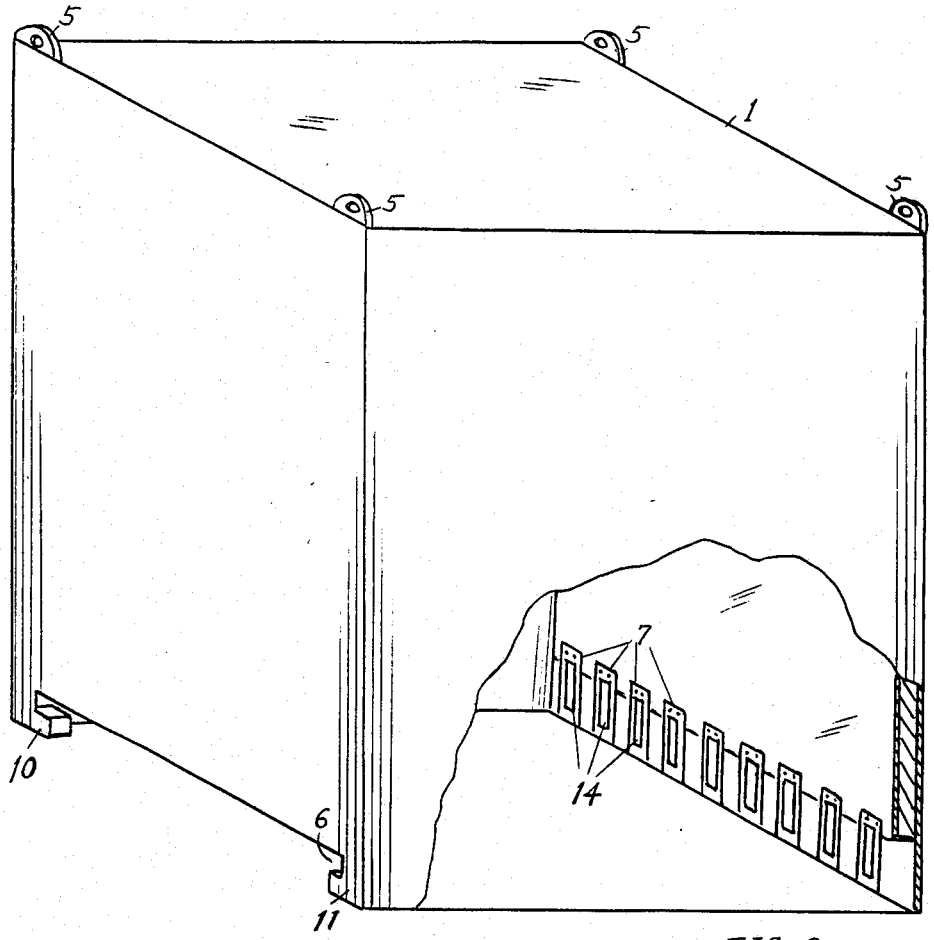
FIG. 2 is a perspective view of container case after removable railing bottom plate of the container and goods are removed.
Figure 3:
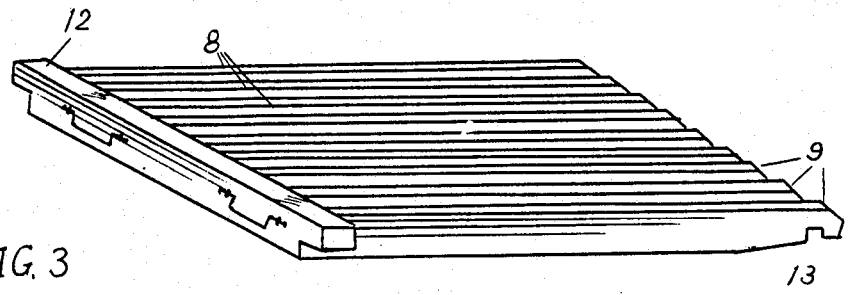
FIG. 3 is a perspective view of the removable railing bottom plate.

Refering to FIG. 1 there is a bottomless container case 1 installed with a removable railing bottom plate 2, a removable railing rack 3, and goods 4 ready for transport in the container. The container case is provided with four hoisting lugs 5 on the top corners of the container case. Said bottomless container case 1 as shown in FIG. 2 having a slot 6 formed at lower front sidewall of the container case. A number of metal connecting rings 7 are fastened on the rear inner sidewall of the container case. The railing bottom plate 2 as shown in FIG. 3 consists of a number of railing bars 8, these bars are arranged in parallel, equally apart, and perpendicularly connected with a lateral bar 12 at one end of the railing bars. The other end 9 of each railing bar having a notch 13 underneath to hook up said connecting rings 7 when the railing bottom plate is inserted into the container case thru the slot 6, meantime said lateral bar 12 will be held in position by retaining posts 10, 11 making the container case connected with the railing bottom plate as a whole unit. Therefore goods in the container can be transported together with the container case and the railing bottom plate. The railing rack 3 as shown in FIG. 4 consists of a number of railing bars 16, they are fixedly arranged in parallel and equally apart on a plate 15, the distance between two parallel railing bars is little larger than the width of the bar on the railing bottom plate, so that said railing bars of the railing rack can be matched alternatively with the railing bars of the railing bottom plate when they are assembled. However, the total top area of the railing bars of the railing rack and the bars of railing bottom plate must be adaptable to fit into the bottom opening of the bottomless container case when they are putting together. Moreover, the height of each railing bar of the railing bottom plate is smaller than the height of each railing bar of the railing rack, therefore, said railing bottom plate is capable to be pulled out and insert into the slot 6 of the container case through the railing rack freely. Thus, whenever the railing bottom plate is removed, the container case can be lifted up by hoist and leave the goods onto the railing rack automatically. On the contrary, whenever the railing bottom plate is inserted into the container case, the goods on the railing rack will be lifted up and transferred onto the railing bottom plate and be transported together with the container case, and leave the railing rack on the ground alone.

On a very long size container, said connecting means such as connecting rings 7 and the slot 6 may be changed their locations to the right and left sidewalls of the container, and the railing bottom plate may be made of more than one section for easier to pull out the railing bottom plate or to insert it into the container case.

Furthermore, both goods loading surface of the railing rack and the railing bottom plate are preferable made of small curve inclining toward the center of the plate to prevent small size goods falling from the top accidentally when the container case is removed.

The improvement is made by adding a pressure plate 17 to each inside wall of the container case, the area of the pressure plate is smaller than the area of the wall on which the pressure plate is installed. There is a recess (dotted line) on each inside wall, the area of the recess is little larger than the pressure plate, the purpose of the recess will be later described. On each corner of the pressure plate having a hinged endless screw 18 for connecting with a sleeve nut 19 on each corner of the side wall of the container case. Said sleeve nut may be rotated in either direction by a driving ring 20 thereon one end of the sleeve nut for telescoping the hinged endless screw inwardly or outwardly, thus, bringing said pressure plate to bear against the goods for security, or retracting said pressure plate into the recess on the wall for easier removing the container case when unloading goods.

Another improvement is made by adding a hook 21 on each corner of the railing rack (see FIG. 9). Said hook having an open end 22 as shown in FIG. 6, the central shaft 23 of the hook is secured and sunk into the railing rack between the railing bars by an anchor plate 24 in such a manner it must not interfere the railing bars of the bottom plate to get in or out of the railing bars of the railing rack. Said hook may be rotated 90 degrees by a ring 25 to lay down the open end of the hook for hoisting the railing rack together with the railing bottom plate. A rubber packing 26 may be attached on the edges of the railing rack for water proof when the lower edges of the container case ride over the packing and a hook 27 may be hooked to a key 28 on each outer wall of the container case for tightness. Further more, certain numbers of connecting rings 29 and bolts 30 are fixedly mounted on the lower front edge of the container case and on the lateral bar of the bottom plate respectively for strengthening the strength of the lateral bar.

OPERATION PROCEDURES

1. To move goods from one location to the other location or to transport them by cars:
   (1) Put the railing rack on the ground.
   (2) To pile the goods on the top surface of the railing rack, care must be taken do not over run the goods beyond the top area of the railing bars.
   (3) Put the container case vertically down to cover the goods until the bottom opening of the container case matches with the edges of the railing rack.
   (4) Insert the railing bottom plate into the container case through the slot 6 until the lateral bar 12 is held in position by the posts 10, 11, also the notches at the end of the railing bars will be hooked up with the connecting rings.
   (5) Use a hoist or crank to lift up the container case together with the railing bottom plate and goods away from the railing rack, then put them on a car for transport, or put them on a spare railing rack at the place where the goods are subjected to storage.
2. To remove the goods out of a container for inspection or unloading:
   (1) Put a spare railing rack on the ground for inspection or unloading.
   (2) Hoist the container together with the railing bottom plate and goods and then put them down on the railing rack, make sure that the bottom opening of the container case is closely matched with the surrounding edges of the railing rack.
   (3) Pull out the railing bottom plate from the slot of the container case.
   (4) Hoist the container case streight up and leave the goods on the railing rack.

We claim:

1. An apparatus for loading and shipping a consignment of goods, said apparatus comprises a bottomless container case, a removable railing bottom plate and, a pallet, said bottomless container case having bottom opening wide opened to each side wall of the container case, said pallet comprising a base plate in the same size as the bottom opening of the container case plus the thickness of the side walls, a number of railing bars being fixedly arranged in parallel and equal apart on said base plate occupying a size little smaller than the bottom opening, so that said railing bars can project into the bottom opening of the container case when the latter is put to cover the pallet, a slot and certain number of hook rings or sockets which serve as automatic connections means for the railing bottom plate are formed at lower edges of the front and rear side walls of the container case respectively, the railing bottom plate comprising a same number of railing bars minus 1 as the pallet and are arranged in parallel and equal apart, they have a common lateral bar formed at their forward ends, on the other end of them having notches formed thereon for the automatic connection means, each railing bar of the railing bottom plate is made smaller in width and height than the space between the paralleled railing bars and the height of the railing bars of pallet respectively, but are longer in length in order that when the railing bottom plate is to be inserted into the container case through said slot and the interval gaps of the railing bars of the pallet, they are long enough to reach into the hook rings or sockets for the automatic connection, thus when the container case is lifted to transport, both ends of the railing bars of the bottom plate may be lifted up by said automatic connections like a sedan chair and transferring the consignment from the pallet onto the railing bottom plate.

2. A process for using with an apparatus as set forth in claim 1, wherein said apparatus comprises a bottomless container case, a removable railing bottom plate and a pallet, consignment is pre-stacked on the pallet ready for shipping, the bottomless container case is lowered vertically over the consignment and meets the pallet, then the railing bottom plate is inserted into the bottom of the bottomless container case and connected with the container case by automatic connections thereon, then the container case and the railing bottom plate are lifted for shipping by using Fork-Lift-Truck or Truck with crank, the consignment will be transferred from the pallet onto the railing bottom plate in the container automatically and leaves the pallet in its original plate for another consignment, reverse process for unloading the consignment from the container and the railing bottom plate onto the pallet.

* * * * *